United States Patent [19]

Jensen et al.

[11] 4,114,349

[45] Sep. 19, 1978

[54] AUTOMATIC SORTING, CONVEYING AND PACKING MECHANISM FOR PHOTOGRAPHIC PRINTS

[75] Inventors: Gerald A. Jensen, Wayzata; Louis A. Larson, Minneapolis; Robert E. Diesch, Rogers, all of Minn.

[73] Assignee: Pako Corporation, Minneapolis, Minn.

[21] Appl. No.: 786,184

[22] Filed: Apr. 11, 1977

[51] Int. Cl.[2] ..... B65B 57/14

[52] U.S. Cl. ..... 53/54; 53/493; 53/520; 209/74 R

[58] Field of Search ..... 53/54, 59 R, 123; 209/74 R; 83/79, 106

[56] References Cited

U.S. PATENT DOCUMENTS

| | | | |
|---|---|---|---|
| 3,531,108 | 9/1970 | Rabinow et al. | 209/74 R X |
| 3,789,571 | 2/1974 | Tall et al. | 53/59 R X |

*Primary Examiner*—Travis S. McGehee

*Attorney, Agent, or Firm*—John W. Adams; David R. Fairbairn

[57] ABSTRACT

A photographic print sorting, conveying and packing mechanism includes a main conveyor line and a plurality of branch conveyor lines with an initial feeding device which receives individual cut prints from a print cutter and feeds the prints into the main conveyor line which defines a main flow path. All of the conveyor lines include a plurality of driver rollers spaced apart less than the length of each cut photograph so that one roller will always be in contact with the prints to maintain positive driving contact with the prints at all times during their successive travel along the conveyor lines. The conveyor lines also include deflecting elements ahead of each roller to flatten momentarily the curl in each print and insure proper driving engagement between the rollers and the print. The branch conveyor lines have their entrances communicating with the flow path of the main conveyor line, the entrances being normally closed by diverting flippers which, when actuated, move into the main flow path to divert previously classified prints into the respective branch conveyor lines in response to classification indicia incorporated in the prints. Print collecting and ejecting stations are provided at the end of the respective conveyor lines, with a positive automatic ejection mechanism provided at the end of said main conveyor line for packing the collected prints into a packaging envelope positioned to receive the prints.

16 Claims, 10 Drawing Figures

AUTOMATIC SORTING, CONVEYING AND PACKING MECHANISM FOR PHOTOGRAPHIC PRINTS

BACKGROUND OF THE INVENTION

In the past, efforts have been made to produce automatic sorting and conveying equipment for photographic prints whereby the packaging of the prints can be expedited. Photographic print paper generally produces curled prints which are very difficult to handle and convey, and jams frequently occur with conventional conveyor systems. Further, static charge quickly builds up to a high level in the paper as it is handled and conveyed, and thus the paper tends to cling to the conveyor and causes jams. The prior art systems also fail to consistently and satisfactorily feed the individual cut prints into a suitable packaging envelope because the curled prints frequently hang-up during the feeding operation and thus are difficult to automatically introduce into a packaging envelope.

SUMMARY OF THE INVENTION

The present invention provides an automatic print conveying and sorting mechanism which receives the cut prints from a print cutter, conveys the good prints along the flow path of a main conveyor line while maintaining positive driving engagement with the good prints continuously throughout the flow path, and automatically diverts previously classified unacceptable prints, such as reject and remake prints, into branch conveyor lines. The diversion of classified prints is achieved by diverting flippers designed normally to cover the entrances of the respective branch conveyor lines so that the good prints pass smoothly along the main conveyor line, but being movable into diverting position in the main flow path to deflect the reject and remake prints out of the main flow path into the respective branch conveyor lines in response to classifying indicia embodied in said remake and reject prints. The mechanism further include collecting means at the ends of the respective conveyor lines to collect and hold each order of prints and ejecting means to positively feed the good prints of each order into a packaging envelope.

The present invention in its preferred embodiment provides driving means for the conveyor lines comprising a plurality of rollers spaced so that each print will be continuously in contact with at least one of the rollers as it is driven along the conveyor lines. The driving means also includes generally inclined deflector plates positioned ahead of each roller to flatten momentarily each print being transported along the conveyor lines, thereby ensuring feeding of prints from one roller to the next and preventing jamming of the mechanism by curled prints.

DETAILED DESCRIPTION OF THE PREFERRED EMBODIMENT

Figure 1:
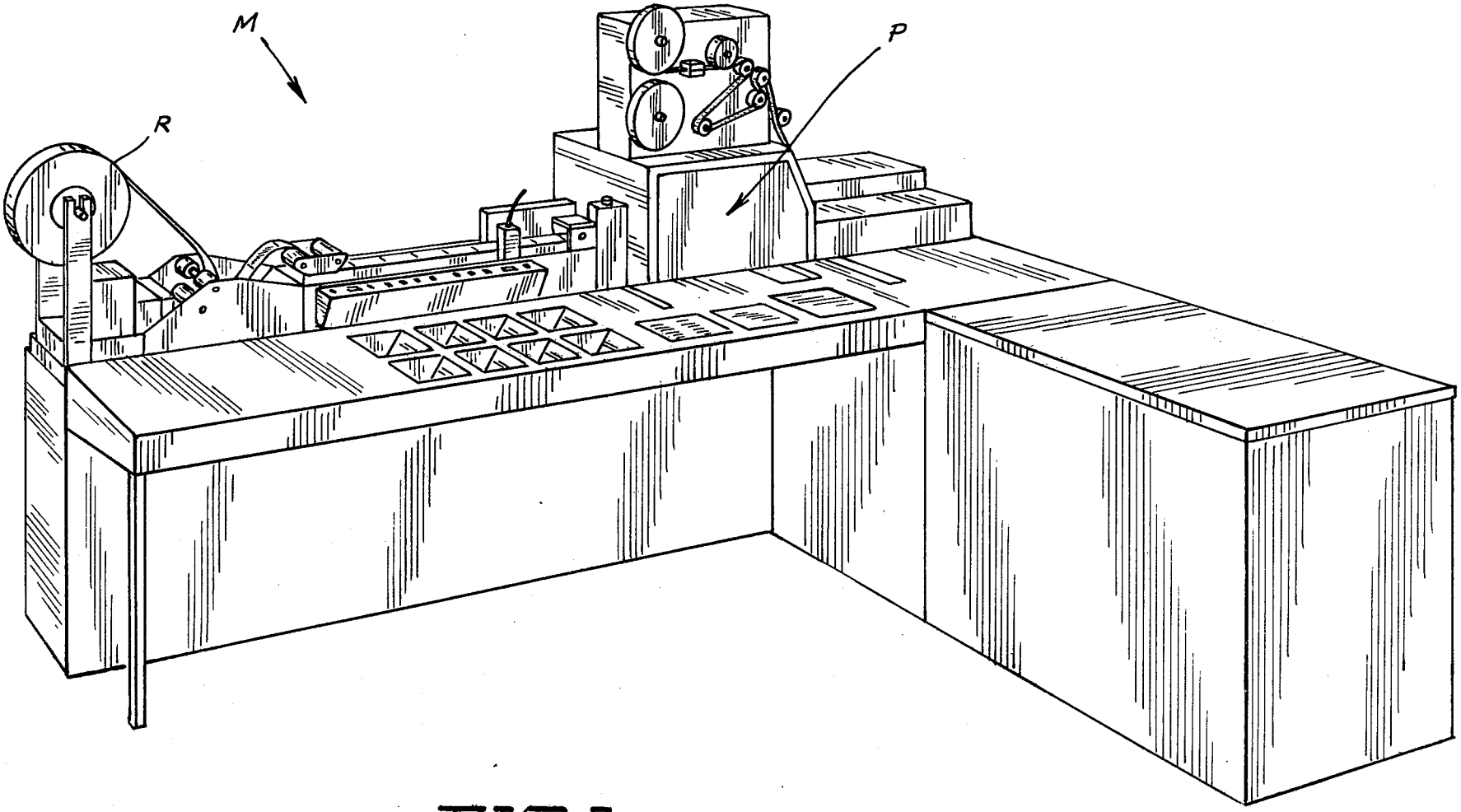
FIG. 1 is a perspective view of a complete machine for automatically packaging individual photographic developing and printing orders, which includes the print sorting, conveying and packing mechanism of the present invention.
Figures 2, 3:
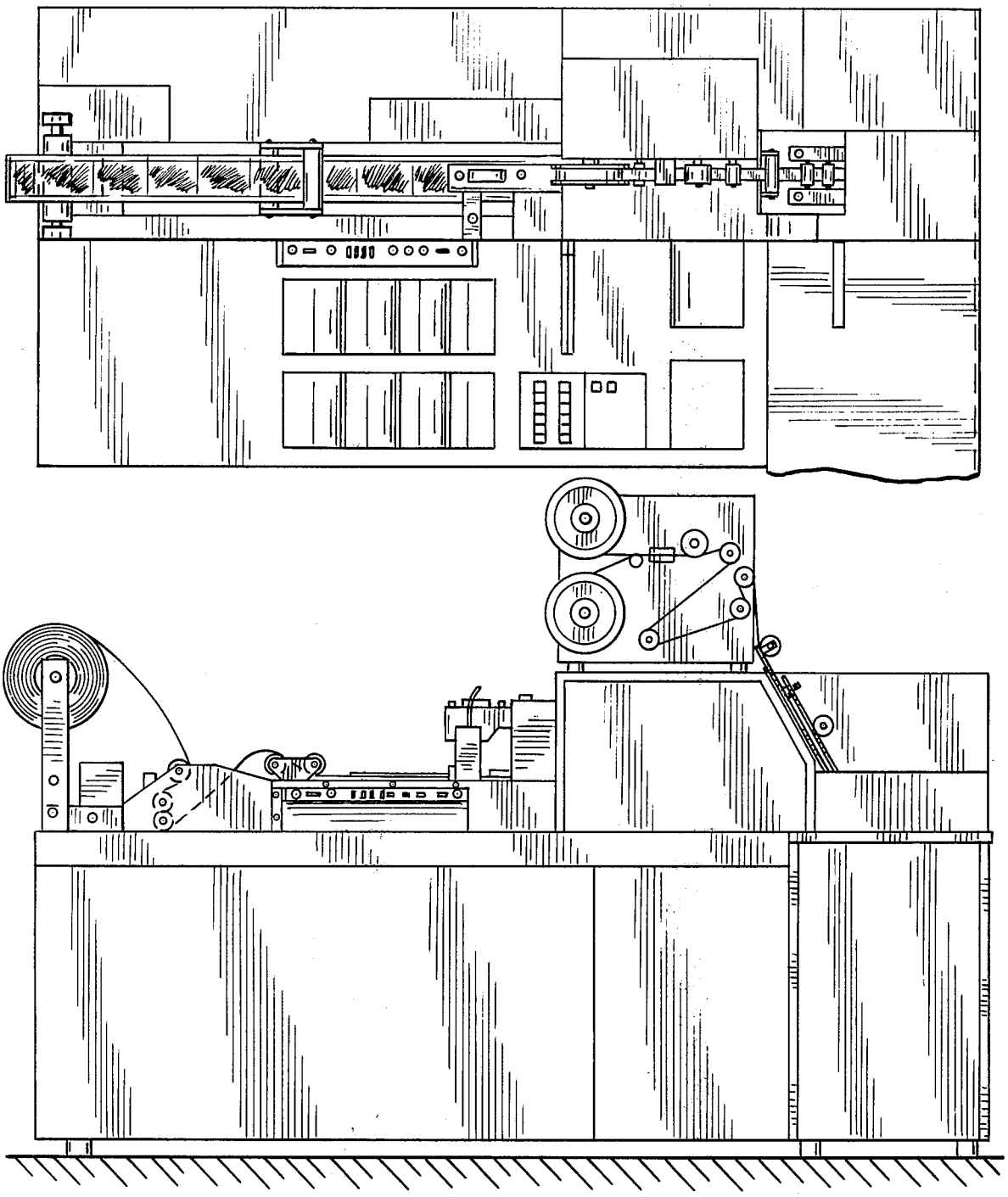
FIG. 2 is a top plan view thereof.
FIG. 3 is a front elevational view thereof.

FIGS. 1–3 show a complete machine M for automatically packing developed and printed photographic film. Machine M includes the present invention, which is best shown in its relation to machine M by FIGS. 3 and 4A and 4B and is identified in its entirety by the letter P.

Figures 4A, 4B:
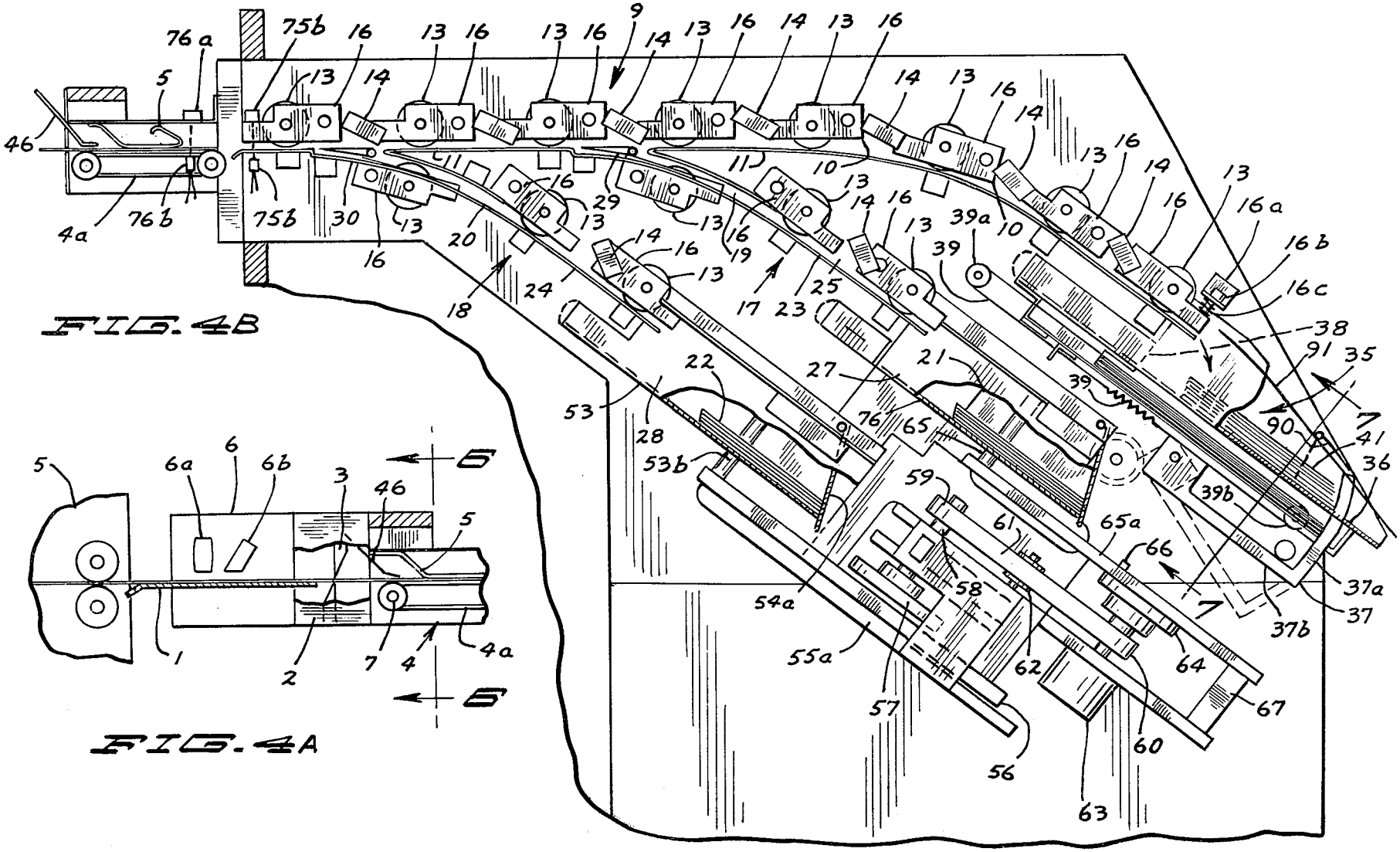
FIGS. 4A and 4B show a portion of the machine shown in FIGS. 1–3 with the front panel removed to shown in front elevation the print sorting, conveying and packing mechanism of the present invention with portions thereof broken away.

As shown in FIGS. 4A and 4B, a strip of prints 1 is delivered to a cutter 2 from a roll of prints R (shown in FIGS. 1–3), which contains a large number of individual customer orders. Cutter 2 comprises a pair of cutting elements 3 respectively positioned on opposite sides of strip 1. Cutter 2 is preferably mounted on a slide carriage and is retractable toward the roll of prints R so as to facilitate repairs.

Figure 6:
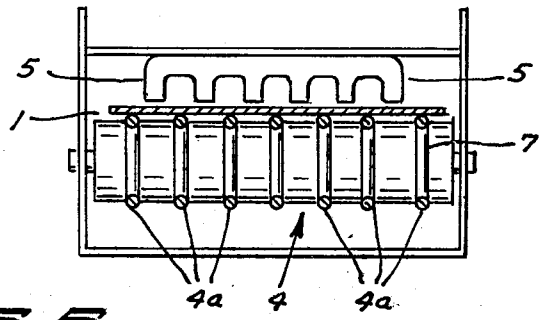
FIG. 6 is a vertical sectional view of the print feeding mechanism taken substantially along the section line 6—6 of FIG. 4A.

The edges of strip 1 pass through print indexing and "end of order" sensors which are positioned upstream of said cutter 2 on on either side of strip 1. The sensors each comprise a light source (now shown) and a photosensitive element (not shown) positioned so that said edges pass between them. The leading end of strip 1 is fed through cutter 2, as by an intermittent drive which is controlled by the print indexing sensor and its control circuitry (not shown), and onto a constantly moving feed conveyor 4 which in the form shown embodies a plurality of "o-ring" type feed belts **4*a*. The leading end is kept in contact with feed belts 4*a* by flexible spring fingers 5 which normally extend down and between the top runs of belts 4*a*. The arrangement of fingers 5 with respect to belts 4*a* is best shown in FIG. 6. An inclined deflecting plate 4*b* is positioned in close relation to the receiving end of belts 4*a*, the distance between the bottom edge of plate 4*b* and belts 4*a* being slightly greater than the thickness of strip 1**.

A print classification sensor 6 is attached to the upstream end of cutter 2 to sense the classification indicia such as light absorptive markings on the prints. Sensor 6 is positioned in close relation to the upper side of strip 1, and comprises an incandescent light **6*a* and a infrared light sensitive element 6*b*. Length detecting sensors 75 and 76 are mounted in close relation to said feeding conveyor 4 as shown and comprise respectively a pair of photosensitive elements 75*a* and 76*a* positioned above conveyor 4 and are in aligned relation to a pair of light sources 75*b* and 76*b* respectively, which are positioned below conveyor 4. The photosensitive element-light source pairs define a pair of light paths 75*c* and 76*c* which are interrupted by the strip passing between photosensitive elements 75*a* and 76*a* and light sources 75*b* and 76*b***.

Feed belts **4*a* are positioned immediately ahead of the entrance of a main conveyor line 9, which includes a smooth conveyor bed 11 suitable for supporting the individual prints as they are transported therealong and which defines a main flow path 10. Print driving means are provided in main conveyor line 9 and comprise a plurality of spaced drive rollers 13 rotatably mounted on individually adjustable pivotally mounted spring loaded support arms 16 which permit adjustment of the individual rollers with respect to conveyor bed 11. The spacing between rollers 13 is less than the length of the shortest print to be conveyed so that each individual print 15 traveling along said flow path 10 will always have positive drive engagement with at least one of said rollers 13**.

It has been found that improved operation is achieved by driving belts 4a of the entrance at a faster speed than the remaining rollers 13 of the conveyor. In one preferred embodiment, the speed of the belts 4a is approximately twice the speed of rollers 13, thereby providing a slip drive conveyor portion which accelerates prints to conveyor speed more rapidly.

Figure 5:
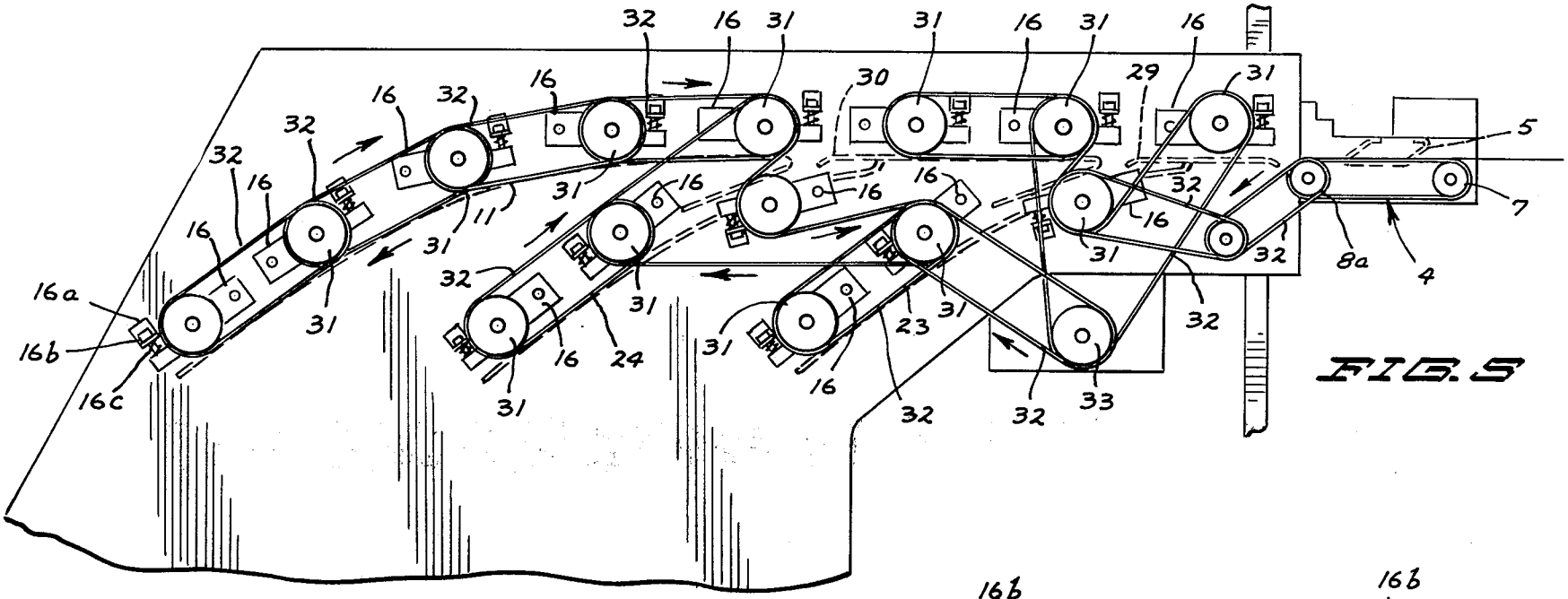
FIG. 5 is a rear elevational view of the print sorting, conveying and packing mechanism.

The drive mechanism for rollers 13 is shown in FIG. 5, which is a rear elevation view. The position of the various elements, therefore, are reversed from those shown in FIG. 4B, since FIG. 4B is a front elevation view. In FIG. 5, pulleys 31 are fixed to rollers 13 and are rotatably interconnected as shown by a plurality of flexible drive belts 32 and are driven by a constantly rotating drive pulley 33 which is connected to rotating drive means (not shown). Feed belts 4a are also driven by drive pulley 33 through belts 32 arranged as shown.

In FIG. 4B, an inclined deflector plate 14 is mounted between each two of the rollers 13. The downstream end of each of the plates 14 is more proximately disposed toward conveyor bed 11 than the upstream end, but of sufficient height from bed 11 to allow individual prints 15 to pass thereunder.

A remake print conveyor line 17 and reject print conveyor line 18 branch off from said main conveyor line 9 with their entrance chutes respectively communicating therewith and defining flow paths 25 and 26 for remake and reject prints, respectively. Remake and reject conveyor lines 17 and 18 respectively include remake and reject print beds 23 and 24, a plurality of rollers 13 rotatably mounted on pivotally mounted arms 16 as described above and positioned in the respective remake and reject print flow paths, a generally inclined deflector plate 14 mounted in the above described position between the last two of the plurality of rollers 13, and remake and reject print collecting and ejecting mechanisms 27 and 28 fixed in closely spaced relation to the respective discharge ends of beds 23 and 24. The openings of entrance chutes 19 and 20 are normally closed by a pair of diverters 29 and 30 which comprise, in the form shown, generally wedge shaped rectangular plates which are normally positioned flush with main conveyor bed 11 and are pivotally mounted to main conveyor bed 11 at their downstream ends.

Figure 7:
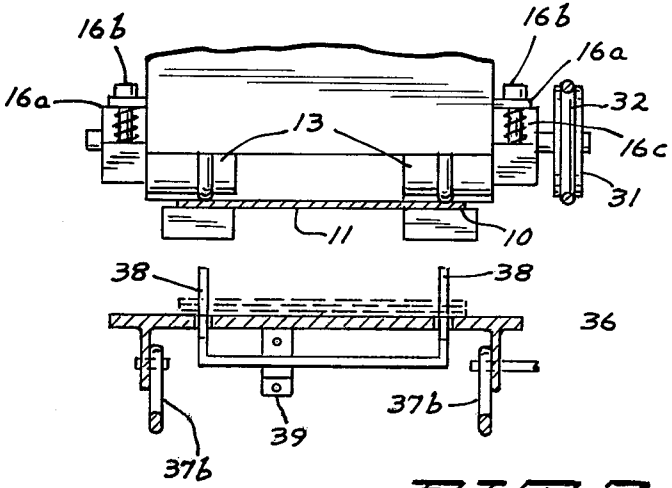
FIG. 7 is a vertical sectional view of the collecting station taken substantially along the section line 7—7 of FIG. 4B.

In FIGS. 4B and 7, a good, or unclassified, print collecting and ejecting mechanism 35 is positioned in close fixed relation to the discharge end of bed 11 conveyor line 9. Mechanism 35 includes a collecting plate 36 positioned in parallel relation below the discharge end of conveyor line 9 and a rigid L-shaped stopping element 37 having its cover arms 37b pivotally connected below plate 36 to the shaft of a solenoid and having its upper arms 37a generally curved inwardly toward conveyor line 9 and normally projecting upwardly and through openings in the end of plate 36 furthest from the discharge end of conveyor line 9. An ejecting element 38 is normally positioned in close relation to the end of plate 36 nearest the discharge end of conveyor line 9 and is adapted to be moved along plate 36 by means of drive cable 39 trained around pulleys 39a and 39b and connected to the bottom of element 38. A spring 39c connects the two ends of drive cable 39 together. A generally curved print discharge deflecting plate 91 is positioned above plate 36 at a height greater than that of the discharge end of bed 11 and extends substantially the entire distance between the said discharge end of bed 11 and said stopping element 37. A packaging envelope (not shown) is positioned in close relationship to upper arms 37a to receive a stack 41 of prints ejected from mechanism 35. Further description of a preferred packaging envelope may be found in the co-pending applications filed Apr. 11, 1977 entitled "Automatic Photographic Print and Film Packaging Mechanism" Ser. No. 786,182 and "Automatic Film Conveying and Packing Mechanism" Ser. No. 786,183 which are assigned to the same assignee as the present application.

Figure 8:
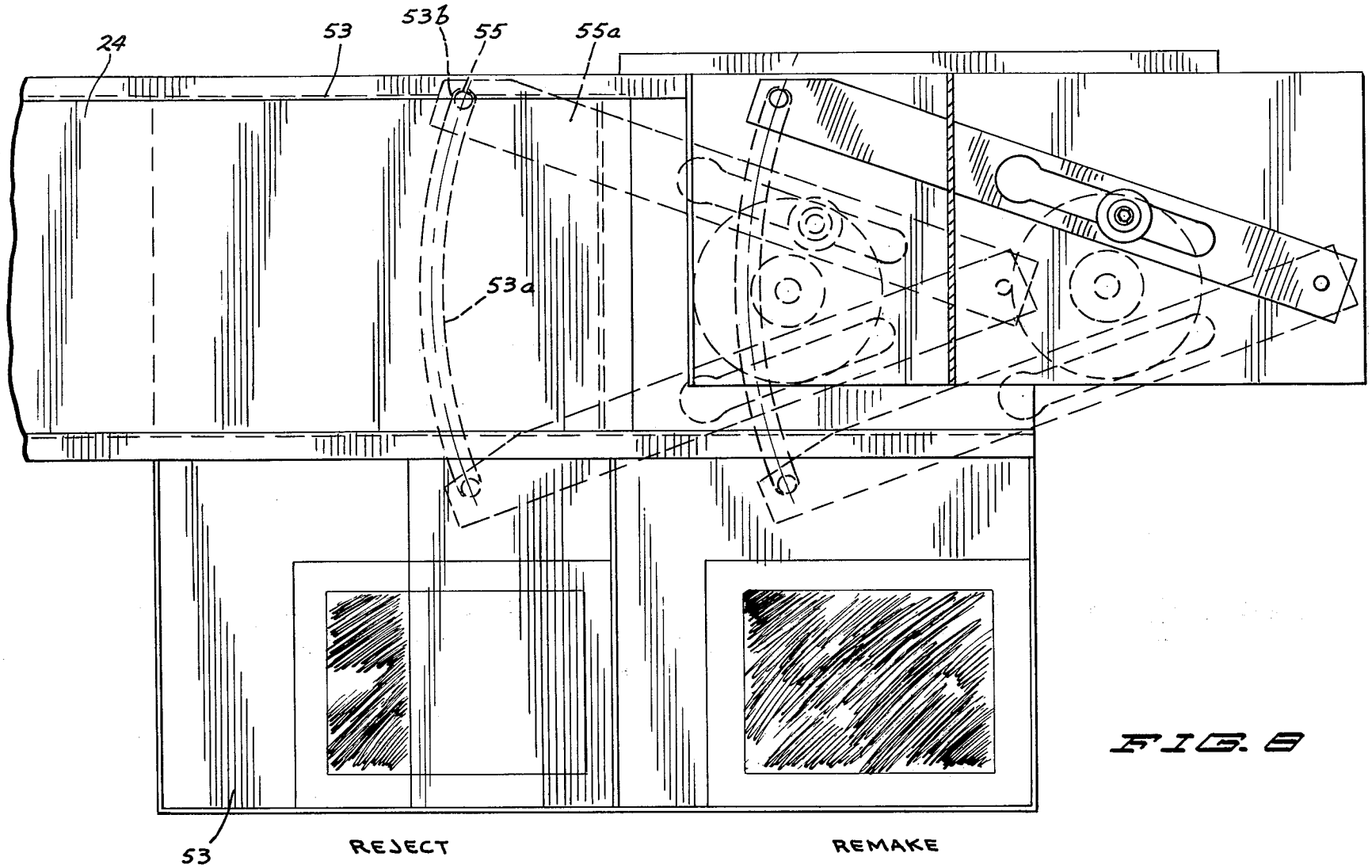
FIG. 8 is a top plan view showing the remake and reject print collecting and ejecting stations.
Figure 9:
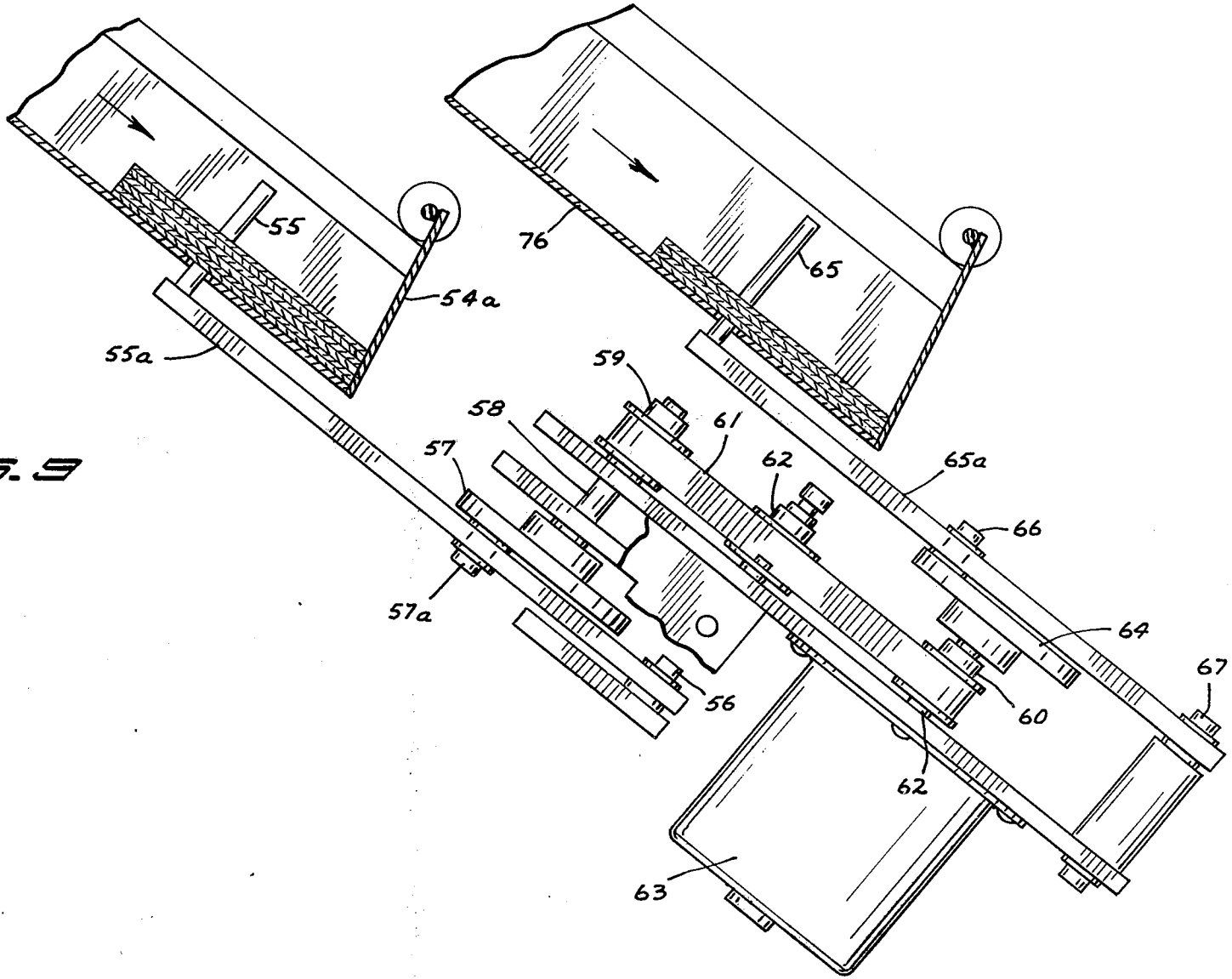
FIG. 9 is a front elevational view showing the remake and reject print collecting and ejecting stations.

FIGS. 8 and 9 show the reject print collecting and ejecting mechanism 28 which is a generally rectangular container 53 open at the top and fixed in closely spaced relation to the discharge end of reject print bed 24. Container 53 has openings 53a and 53b in the bottom and one side respectively to permit the insertion of an upright reject stacking bar 55 which is normally positioned in closely spaced relation to the side opening. Container 53 has a section 54a of the end 54 remotely disposed from the discharge end of print bed 24 and adjoining the other side of container 53 pivotally connected at its top and normally closed, said section 54a being wider than said prints.

Lower arm 55a of stacking bar 55 is rotatably connected at its end to a post 56, and is slidably mounted to a cam 57 by a bolt 57a. Cam 57 is rotatably mounted on a shaft 58 upon which a pulley 59 is mounted. Pulley 59 is connected to a pulley 60 by a timing belt 61, constant tension being placed upon timing belt 61 by an idler pulley 62. Pulley 60 is carried by shaft 62 of a motor 63. A remake cam 64 is mounted on the end of said shaft 62 and is slidably mounted on a lower arm of a remake stacking bar 65. The end of lower arm 65a is rotatably mounted on a post 67.

FIGS. 8 and 9 also show remake collecting and ejecting mechanism 27, comprising a generally rectangular container 76 with the top open and positioned in closely spaced relation to the discharge end of remake print bed 23. Container 76 has openings in the bottom and one side to allow insertion of said remake bar 65, which is normally positioned outside container 76, and in close upstanding relation to the side opening.

In typical operation, strip 1 has a small indexing notch on one edge between each two prints contained thereon, and a similar small notch (i.e. an "end of order mark") on the other edge to separate the individual customer orders. Intermittent feed means (not shown) feed strip 1 through cutter 2 and into contact with feed belt 4 until a print indexing notch is sensed by the print indexing sensor. Signals are produced by the print indexing sensor which act to deenergize the intermittent feed means. The leading print is then cut from strip 1 by cutter 2.

Light from light 6a of indicia sensor 6 is directed downwardly toward strip 1. The light reflected from the prints contained on strip 1 is received by a suitably positioned infrared light sensitive element 6b. Classification indicia are incorporated onto the faces of certain prints which signify that those prints are not of acceptable quality. Reject prints (where the negative is so improperly exposed that there is no possibility of producing an acceptable print) are marked, in one practice of the present invention, by a single line drawn with a black fiber pencil across their faces. Remake prints (where it it possible to produce an acceptable print by modifying the printing operation) are marked by a plurality of said lines. The fiber pencil marking material is more infrared light absorbent than the face material of the prints. The line or lines reflect less infrared light than the unmarked portions of the prints so that the amplitude of the signals produced by element 6b vary in response to the infrared light reflectivity of that portion of the print being passed thereunder. Conventional electronic means (not shown) receive the signals and count the variations in amplitude of the signals produced relating to each print. If one variation is sensed, the print is classified as a reject print, and if a plurality of variations is sensed, the print is classified as a remake print. The classification of each print is held in electronic storage means (not shown) until that respective print enters the main conveyor line 9.

Deflecting plate 4b counteracts any upward curling of the leading end of strip 1 by forcing the leading end downwardly toward belts 4a. Flexible spring fingers 5 perform a clutching function in relation to the leading end of strip 1 and belts 4a, enabling the belts 4a to slip underneath the end without driving the strip further through cutter 2, but enabling belts 4a to positively engage the leading print and drive it into main conveyor line 9 when the leading print is cut from strip 1 by the cutting elements 3.

The long and short sensors 75a–75b and 76a–76b are positioned, in one successful embodiment of the present invention, 5 inches and 3.5 inches respectively from the cutting element plane. This embodiment cuts no prints which are shorter than 3.5 inches or longer than 5 inches. Thus, if the leading end of strip 1 does not intersect light path 76c when the intermittent feed means are deenergized for the cutting operation, cutter 2 would cut the print too short and, therefore, sensor 76a–76b produces signals which shut down the conveyor lines 9, 17, and 18 and allow the operator to remedy the problem. If, however, the leading end of the strip 1 intersects light path 75c when the intermittent feed means are deenergized, cutter 2 would cut too much from strip 1 and so sensor 75a–75b produces signals which also shut down conveyor lines 9, 17, and 18.

The cut print 15 is driven into the entrance of the main conveyor line 9 and into continuous driving engagement with the rollers 13. If a print is curled or warped, in either an upward or downward direction, deflector plates 14 force the print downwardly toward bed 11 and momentarily straightens the print, thus ensuring positive engagement of the leading edge of the print with the rollers 13. This prevents a curled or warped print from being driven above rollers 13 because of the curling or warping and thereby jamming conveyor lines 9, 17, and 18.

As the cut print 15 enters the main conveyor belt line 9, the classification signals are retrieved from the electronic storage means and are received by electronic diverting means (not shown) which actuate the proper diverters 29 and 30 according to the classification of the print 15. For example, if the print 15 were classified as a reject print, diverter 30 would be actuated and pivoted upwardly into the main flow path 10. The print would then contact diverter 30 and be driven downwardly and into the reject entrance chute 20, where it would be then driven by rollers 13 along reject print line 18 and be discharged into reject transfer mechanism 28, where said prints form a stack 22. A similar operation is performed for remake prints. Both reject and remake conveyor lines 18 and 17 have electronic sensing means (not shown) to sense whether the respective prints are delivered into transfer mechanisms 28 and 27, or whether the respective prints are jammed or delivered to the wrong location, in which event the conveyor lines 9, 17, and 18 are shut down so that the operator can remove the jammed or misdelivered print.

Unclassified (i.e. good) prints are driven by rollers 13 along the main flow path 10 past diverters 29 and 30 and are discharged from bed 11 and are guided by plate 91 onto collecting plate 36, where they form a stack 41 which contacts the upper arms 37a of stopping element 37. The stack 41 exerts an upwardly directed force on upper arms 37a by reason of the inward curvature, thus holding upper arms 37a in the normally upwardly projected position. The use of a pivot point for lower arms 37b below the plane of the collecting plate 36 and the inward curvature of the upper arms 37a permits the use of a weak tension torsion spring to keep the upper arms 37a in the upwardly projected position and thus permit the use of a low power solenoid 37 to pivot element 37 downwardly and away from collecting plate 36.

When short (e.g. 3.5 inch) prints are being discharged onto plate 36, there is a possibility because of the curving of the prints that the leading edge of a print being discharged will catch on the trailing edge of a print previously discharged onto the plate 36. This would jam the mechanism and damage the prints. This possibility can be eliminated by providing a second stopping element 90, which in the form shown comprises a pair of generally straight arms. Element 90 is shown in stopping position by the broken lines in FIG. 4B, extending on either side of plate 91 and removably positioned in substantially perpendicular through plate 36 and disposed slightly more than a short print's length from the discharge end of bed 11. Stopping element 90 is positioned out of the discharge path of large prints, but is lowered into the relation with plate 36 by conventional means such as solenoid (not shown) when short prints are to to be discharged from bed 11. When a short print is discharged, its leading edge contacts element 90, thus positioning the trailing edge of the print such that it will not impede the following print. This prevents the leading edges of subsequent prints from catching the trailing edge of prints already discharged. When the last print is discharged onto plate 36, element 90 is then raised out of the discharge path and the prints are ejected as described below.

Main conveyor line 9 also includes electronic sensing means (not shown) to determine if a good print entering line 9 is deposited on plate 36. If not, lines 9, 17, and 18 are shut down to allow the operator to remedy the problem.

When the end of order sensor senses an end of order notch on the edge of strip 1, it produces signals which initiate the ejecting operations. When the last print of the order is received by any of the collecting and ejecting mechanisms 17, 18, or 35, after a short delay to allow the last delivered print to come to rest, rotating means (not shown) rotate pulley 39a which drives ejecting bar 38 into contact with the stack of good prints 41 and aligns the prints in stack 41 against the upstanding arms 37*a*. The solenoid then pivots stopping element 37 downwardly and away from plate 36 and ejecting bar 38 is rapidly accelerated and drives stack 41 of plate 36 into an envelope positioned to receive stack 41. Spring 39*c* provides compliance within the ejecting system in such cases as impacting fixed or stationary objects.

Simultaneously with the driving of stack 41 of good prints, motor 63 rotates cams 57 and 64, which drive reject and remake stacking bars 55 and 65 respectively into containers 53 and 76, forcing the stack of reject and remake prints 22 and 21 against the other side of containers 53 and 76. Stacking bars 55 and 65 are then returned to their normal positions, thus allowing easy operator inspection of stacks 22 and 21. The pivoted section 54*a* of end 54 can be pivoted upwards by means (not shown) to allow stack 22 of reject prints to drop into disposal means (not shown) positioned in close relation to pivoted section 54*a*.

It will be seen that the present invention provides a highly efficient and automatic sorting, conveying, collecting and ejecting mechanism for photographic prints which continuously drives the prints along the conveyor lines and positively ejects the sorted good prints from a fixed collecting station into a packaging envelope.

It will be understood, of course, that various changes may be made in the form, details, arrangement and proportions of the parts without departing from the scope of this invention as set forth in the appended claims.

What is claimed is:

1. A sorting, conveying, and packing mechanism particularly adapted for use with photographic print processing equipment, the mechanism comprising:

a cutting mechanism for cutting individual prints from a continuous roll of processed photographic prints;

a main conveyor line defining a main flow path for individual prints cut by the cutting mechanism;

means for feeding the individual prints into the main conveyor line;

a branch conveyor line defining a secondary flow path and having an entrance communicating with an intermediate portion of the main conveyor line to receive prints diverted from said main flow path;

first conveying means for engaging and transporting prints along the main flow path;

diverting means positioned in the main flow path to normally close the entrance to the branch conveyor line and normally permit the prints being transported along the main flow path to pass the entrance to the branch conveyor line but being movable into the main flow path to obstruct the main flow path and open the entrance of the secondary flow path and divert certain of the prints from the main flow path into the secondary flow path;

means for scanning classification indicia associated with the main flow path ahead of the entrance to the branch conveyor line;

actuating means for moving the diverting means into diverting position in response to a signal from the scanning means;

an accumulating station at a discharge end of the main conveyor line for collecting the prints which pass the entrance without being diverted;

means for positively engaging and ejecting the collected prints from the accumulating station into a packaging envelope; and means for discharging from the branch conveyor line the prints diverted from the main conveyor line.

2. The apparatus set forth in claim 1 wherein the means for feeding individual prints into the main conveyor line comprises:

a plurality of belts positioned adjacent to each other and encircling a pair of constantly rotating drive rollers, to transport the individual prints thereon; and a flexible friction-producing element disposed on the opposite side of an individual print from the plurality of belts to maintain contact of the print by the belts, allowing slippage of the belts along the print while the print is attached to the continuous roll but providing positive driving engagement of the print by the belts after the print is cut from the continuous roll.

3. The apparatus set forth in claim 1 wherein the classification indicia comprises:

a strip of a material which is applied to the face of an unacceptable quality print, the material being more light-absorbent than the face.

4. The apparatus set forth in claim 1 and further comprising:

second conveying means for engaging and transporting the diverted prints along the secondary flow path.

5. The apparatus set forth in claim 4 wherein the first and second conveying means comprise:

a plurality of positively driven rollers positioned in the main and secondary flow paths respectively, the distance between the center points of successive rollers being less than the length of the prints, to continuously engage and drive the prints along their respective flow paths;

spring tensioning means to enable individual adjustment of the rollers with respect to the flow paths for proper print engagement and driving; and plurality of plates positioned in fixed relation between each of the rollers and extending substantially the entire distance therebetween, to substantially straighten warped and curved prints during their travel along the flow paths.

6. The apparatus set forth in claim 5 wherein the plurality of plates are mounted in a generally inclined position in spaced relation between each of the rollers, the upstream edge of each plate being more remotely disposed from the flow path than the downstream edge of each plate, the distance between each downstream edge and the flow path being greater than the thickness of the prints.

7. The apparatus set forth in claim 1 wherein the accumulating station and the means for positively engaging and ejecting comprise:

a collecting plate positioned in close relation to the discharge end of the main conveyor line to receive the prints discharged therefrom;

a rigid L-shaped stopping element to hold and stack received prints on the plate, the stopping element having its lower arms pivotally connected to the bottom of the collecting plate and its upper arms normally projecting upwardly and through slots formed in the end of the collecting plate remote from the discharge end, the upper arms generally curved inwardly toward the discharge end so that the pressure exerted by the received prints against the upper arms helps maintain the upwardly projecting position;

light tension spring means for holding the upper arms in the upwardly projecting print holding position;

means for pivoting the stopping element downwardly and away from the collecting plate;

an ejecting bar normally positioned at the end of the collecting plate remotely disposed from the stopping element and adapted to be moved along the collecting plate toward the stopping element, thereby driving the prints off the collecting plate when the stopping element is pivoted downwardly and away from the collecting plate; and means for elastically driving the ejecting bar along said plate, preventing damage to the ejecting bar and prints the event of a jam.

8. The apparatus set forth in claim 1 wherein the means for discharging from the branch conveyor line the diverted prints comprises:

a generally rectangular container substantially open at its top and positioned in close relation to the discharge end of the branch conveyor line to receive the prints discharged therefrom and through its open top;

an upstanding rigid print stacking bar normally positioned in close relation to one side of the container;

openings formed in the one side and bottom of the container to receive the stacking bar into the container;

means for inserting the stacking bar into the container through the openings to stack received prints against an opposite side of the container; and a section of the end of the container remotely disposed from the discharge end of the branch conveyor line pivotally attached to the container, the length of the section being greater than the width of the prints, to remove therethrough the prints from the container.

9. The apparatus set forth in claim 1 wherein the diverting means comprises:

a generally rectangular plate pivotally hinged at its downstream end to the main conveyor line and normally positioned flush to the bed of the main flow path and closing the entrance to the branch conveyor line and able to be pivoted into the main flow path to divert prints from the main flow path into the secondary flow path.

10. A photographic print sorting and conveying mechanism for sorting and conveying classified and unclassified individual photographic prints, the mechanism comprising:

a main conveyor line defining a main flow path for the individual photographic prints;

feeding means for feeding to the main conveyor individual photographic prints to be sorted and conveyed;

a branch conveyor line defining a branch flow path and having an entrance communicating with an intermediate portion of the main conveyor line to receive prints diverted from the main flow path;

transporting means for transporting the prints along the main and branch flow paths;

diverting means positioned in the main flow path and normally closing the entrance to said branch conveyor line to permit unclassified prints to pass the entrance but being movable into the main flow path to open the entrance of the branch flow path and divert the classified prints from the main flow path into the branch flow path;

actuating means for actuating the diverting element to move into its diverting position to divert the classified prints into the branch flow path;

unclassified print collecting means for collecting the unclassified prints at the end of the main conveyor line, the unclassified print collecting means comprising:

a collecting plate positioned in close relation to the discharge end of the main conveyor line to receive the prints discharged therefrom;

a rigid L-shaped stopping element to hold and stack the received prints on the collecting plate, the stopping element having its lower arms pivotally connected to the bottom of the collecting plate and its upper arms normally projecting upwardly and through slots formed in the end of the collecting plate remote from the discharge end, the upper arms generally curved inwardly toward the discharge end so that the pressure exerted by the received prints against the upper arms helps maintain the upwardly projecting position;

light tension spring means to hold the upper arms in the upwardly projecting position; and means for pivoting the stopping element downwardly and away from the collecting plate;

ejecting means for ejecting the collected unclassified prints from the unclassified print collecting means when a predetermined number of prints have been fed into the main conveyor line by the feeding means; and classified print collecting means for collecting and ejecting the classified prints at the end of the branch conveyor line.

11. The apparatus set forth in claim 10 wherein the diverting means comprises:

a generally rectangular plate pivotally hinged at its downstream end to the main conveyor line and normally positioned flush to the bottom of the main flow path and closing the entrance to the branch conveyor line.

12. The apparatus set forth in claim 10 wherein the ejecting means comprises:

an ejecting bar normally positioned at the end of the collecting plate remotely disposed from the stopping element and adapted to be moved along the collecting plate toward the stopping element, thereby driving the prints off the collecting plate when the stopping element is pivoted downwardly and away from the collecting plate; and means for elastically driving the ejecting bar along the collecting plate, thereby preventing damage to the ejecting bar and the prints in the event of a jam.

13. A photographic print sorting and conveying mechanism for sorting and conveying classified and unclassified individual photographic prints, the mechanism comprising:

a main conveyor line defining a main flow path for the individual photographic prints;

feeding means for feeding to the main conveyor individual photographic prints to be sorted and to be conveyed;

a branch conveyor line defining a branch flow path and having an entrance communication with an intermediate portion of the main conveyor line to receive prints diverted from the main flow path;

a plurality of positively driven rollers positioned in the main and branch flow paths, the distance between each roller being less than the length of the prints, to continuously engage and drive the prints along the flow paths;

a plurality of generally inclined plates positioned in spaced relation between each of the rollers, the upstream edges of the plates being more remotely disposed from the bottom of the flow paths than the downstream edges of the plates, the distance between the downstream edges and the bottom of the flow paths being greater than the thickness of the prints, to force the leading edges of the prints to move downwardly along the plates;

diverting means positioned in the main flow path and normal enclosing entrance to the branch conveyor line to permit unclassified prints to pass the entrance by being movable into the main flow path to open the entrance of the branch flow path and divert the classified prints from the main flow path into the branch flow path;

unclassified print collecting means for collecting the unclassified prints at the end of the main conveyor line; and classified print collecting means for collecting the classified prints at the end of the branch conveyor line.

14. The apparatus set forth in claim 13 and further comprising:

spring tension means to enable individual adjustment of the rollers with respect to the bottom of the flow paths for proper print engagement and driving.

15. A photographic print sorting and conveying mechanism for sorting and conveying classified and unclassified individual photographic prints, the mechanism comprising:

a main conveyor line defining a main flow path for the individual photographic prints;

a branch conveyor line defining a branch flow path having an entrance communicating with an intermediate portion of the main conveyor line to receive prints diverted from the main flow path;

feeding means for feeding to the main conveyor individual photographic prints to be sorted and conveyed, the feeding means comprising:

a plurality of spaced-apart narrow, flexible belts movably mounted on a pair of drive rollers;

a plurality of spaced-apart flexible spring fingers positioned in close relation to the belts and extending between the belts and below the plane of the upper run of the belts; and means for continuously rotating the pair of drive rollers;

transporting means for transporting the prints along the main and branch flow paths;

diverting means positioned in the main flow path and normally closing the entrance to the branch conveyor line to permit unclassified prints to pass the entrance of being movable into the main flow path to open the entrance of the branch flow path and to divert classified prints from the main flow path into the branch flow path;

unclassified print collecting means for collecting the unclassified prints at the end of the main conveyor line; and classified print collecting means for collecting the classified prints at the end of the branch conveyor line.

16. The apparatus set forth in claim 15 wherein the pair of drive rollers rotate at a higher speed than drive rollers in the transporting means.

* * * * *